United States Patent [19]

Worden

[11] Patent Number: 4,897,959

[45] Date of Patent: Feb. 6, 1990

[54] JAIL CELL LOCK MECHANISM

[75] Inventor: Donald A. Worden, Pompton Plains, N.J.

[73] Assignee: Marotta Scientific Controls, Inc., Montville, N.J.

[21] Appl. No.: 324,408

[22] Filed: Mar. 15, 1989

[51] Int. Cl.[4] ..... E05B 47/06; E05F 15/00

[52] U.S. Cl. ..... 49/18; 49/280; 49/358

[58] Field of Search ..... 49/18, 358, 280

[56] References Cited

U.S. PATENT DOCUMENTS

| | | | |
|---|---|---|---|
| 3,426,478 | 2/1969 | Sturges et al. | 49/18 X |
| 3,830,017 | 8/1974 | Markham | 49/18 |
| 4,190,985 | 3/1980 | Richards et al. | 49/18 X |
| 4,625,456 | 12/1986 | La Fontaine | 49/358 |
| 4,641,458 | 2/1987 | Pilcher et al. | 49/18 X |

*Primary Examiner*—Philip C. Kannan

*Attorney, Agent, or Firm*—Hopgood, Calimafde, Kalil, Blaustein & Judlowe

[57] ABSTRACT

A jail-cell door is suspended from an overhead carriage, for horizontal displacement between closed and open positions, and an elongate slide bar has a horizontal lost-motion connection to the carriage. The slide bar mounts a reversible electric motor and is continuously engaged to the driven one of two rollers from which the carriage and its cell door are suspended; the shaft for the other suspension roller is journaled in the carriage. For driving the cell door in the door-opening direction, the outer lost-motion limit determines an expanded wheelbase of door suspension, and for driving the cell door in the door-closing direction, the inner lost-motion limit determines a slightly reduced wheelbase of door suspension. The slide bar carries cam formations at or near its respective ends for determining locking-bolt action only at the fully closed and fully open positions of the door, and a deadlock device is pivotally carried at one end of the slide bar, serving the door-closed condition. Assurance against bodily harm upon door closing is inherent in the design of drive-roller engagement to the rail on which both rollers travel, the engagement being to provide drive-roller slip at a predetermined threshold of tractive force.

8 Claims, 3 Drawing Sheets

JAIL CELL LOCK MECHANISM

BACKGROUND OF THE INVENTION

The invention pertains to lock-operating mechanism specifically applicable to the door or doors of a jail cell, wherein the door or doors are horizontally displaceable, for selectively opening and closing an individual cell door from a remote-control station, and wherein an emergency release bar is independently actuable to open all doors for a given plurality of cells, in the event of a fire or other life-threatening emergency.

U.S. Pat. No. 3,426,478 discloses an illustrative jail-cell door-locking system of the general character indicated, wherein a housing is located above each cell door, in a horizontally distributed succesion of individual cells, as along a corridor. A reversible rack-and-pinion drive means is within each housing for horizontally moving the involved door (via its suspension carriage) between open and closed positions. A horizontally movable emergency release bar extends from the remote-control station and through each of the housings. A vertical locking column is adjacent each door opening, and a locking head is vertically movable within the locking column. Bolt means in each vertical column is fixed to the locking head and engageable with the involved door to hold the door in its closed position. A pivotal deadlock device is provided to prevent vertical movement of the locking head, to thereby prevent unlocking the bolt means. Cam actuator means on the release bar pivots the deadlock device out of deadlocking position and shifts the locking head to unlock all cell doors when the release bar is moved axially. A lost-motion connection between the rack and the carriage permits some motor-driven rack displacement for locking/unlocking purposes, before the driven rack drives the carriage and its suspended door. The drive motor and its rack pinion are carried by a hinged frame that is cam lifted away from rack engagement when the mechanism has fully locked and deadlocked the door in closed position.

Another prior-art mechanism utilizes an endless sprocket-chain drive from a frame-mounted motor to the carriage from which the cell door is suspended, with a lost-motion connection between the sprocket chain and the carriage, whereby the lost-motion connection affords opportunity to release locking-bolt and deadlock devices prior to having the sprocket chain displace the carriage in door-opening and door-closing phases of an overall cycle of operation.

But the mechanism of said patent and of the endless-chain arrangement suffer from the problem of affording inadequate human safety unless additional measures, such as a slip-clutch, are provided in the motor drive to the spur gear (for the rack-and-pinion drive) or to the drive sprocket (for the sprocket-chain arrangement). In both situations, there is added complexity in any such provision, and the inertial factors in other elements of the involved overall system of releasing associated locking-bolt and deadlock mechanisms are greater than I have found to be necessary. As a result, the power-capacity requirements for the reversible electric-motor drive have been greater than I now find to be necessary.

BRIEF STATEMENT OF THE INVENTION

It is an object of the invention to provide an improved cell-door locking/unlocking and door-operating mechanism of the character indicated.

It is a specific object to meet the above object with mechanism of elemental simplicity and low motive-power requirement.

Another specific object is to provide an inherent safety threshold against bodily harm, without requiring additional structural complexity, in cell-door locking and operating mechanism of the character indicated.

Still another further object is to meet the above objects with mechanism that will releasably bolt a given cell door at the open position of the door, as well as in the closed position of the door.

It is a general object to meet the above objects with relatively inexpensive mechanism, of high reliability and featuring ease of maintenance.

The invention in a preferred embodiment achieves the foregoing objects in an arrangement in which an elongate slide bar is carried by the carriage which suspends the cell door, and within longitudinal limits of horizontal lost motion with respect to the carriage. The slide bar mounts a reversible electric motor, and one of the suspension rollers for the carriage is directly driven by the motor; the shaft for the other suspension roller for the carriage is journalled in the carriage. For driving the cell door in the opening direction, the outer lost-motion limit effectively determines an expanded wheel base of door suspension; and for the cell door in the closing direction, the inner lost-motion limit effectively determines a slightly reduced wheel base of door suspension. The slide bar carries cam formations at or near its respective ends for determining locking-bolt action only at the fully closed and fully open positions of the door, and deadlock means is pivotally carried at one end of the slide bar. Assurance against bodily harm upon door closing is inherent in the design of drive-roller engagement to the rail on which both rollers travel, the engagement being to provide drive-roller slip at a predetermined threshold of tractive force.

DETAILED DESCRIPTION

A preferred embodiment of the invention will be described in detail, in conjunction with the accompanying drawings, in which.

Figure 1:
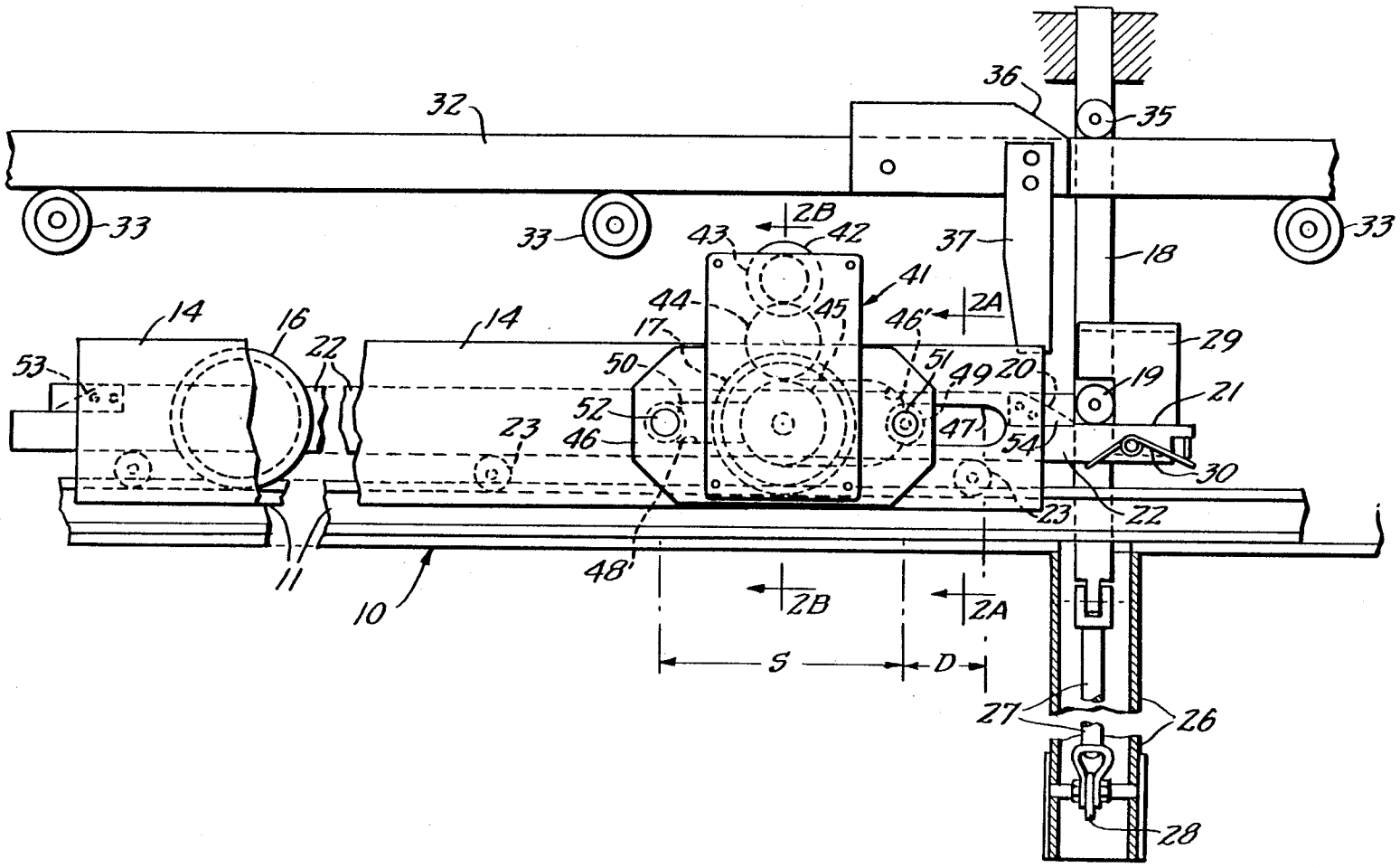
FIG. 1 is a simplified view in elevation of a door-suspension system of the invention, and related bolt-locking and dead-locking mechanism, with housing removed, and for the closed and locked condition of the system.
Figure 2A:
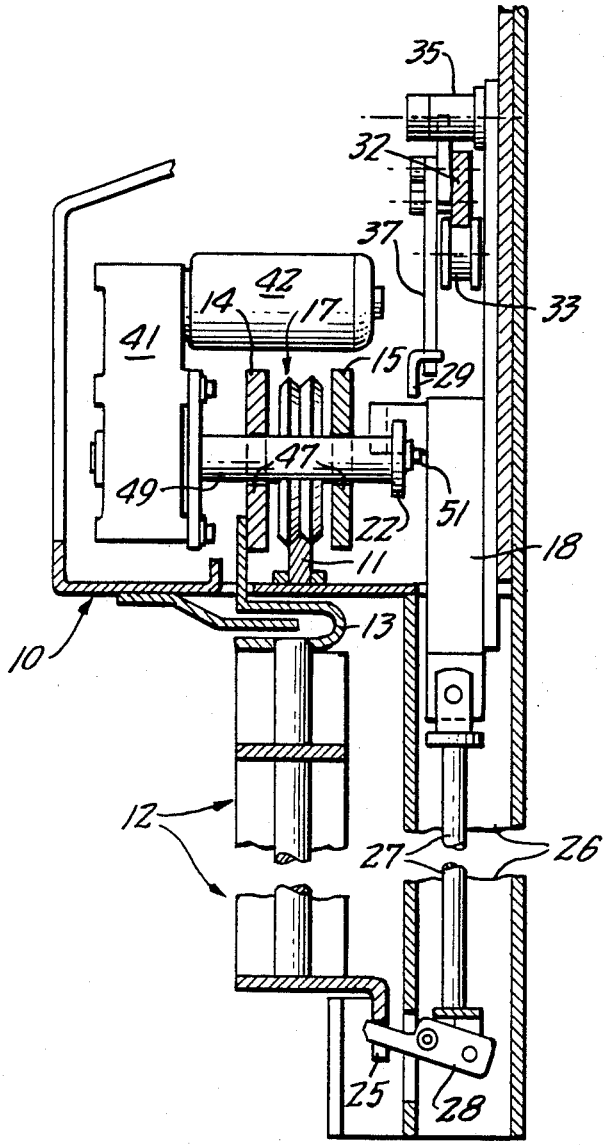
FIGS. 2A and 2B are fragmentary sectional views, taken generally in the plane 2—2 of FIG. 1, but respectively showing two different central details of constant at planes 2A—2A and 2B—2B of FIG. 1.

The mechanism shown in FIGS. 1 and 2A is largely contained in a horizontally elongate housing 10 which will be understood to be mounted above and to one side of the opening of a jail-cell door. An elongate rail 11 on the floor of housing 10 extends the length of the housing and, in the event of a row of successive adjacent cells, may extend through the housing 10 in each of a plurality of cells. It unduly complicates FIG. 1 to show the cell door 12, but in FIG. 2A door 12 is seen to be suspended via a hanger element 13 from one of the side plates 14, 15 of an elongate carriage having spaced rollers 16, 17 via which the carriage and its suspended door will ride the rail 11. The length of the carriage and its hanger element 13 will be understood to substantially match the horizontal or width dimension of door 12.

Each of the rollers 16, 17 is shown with a peripheral V-groove by which it maintains accurate tracking engagement with the inverted-V contour of rail 11 throughout the course of movement between open and closed positions of door 12; FIG. 1 depicts the door-closed condition, and an opening of door 12 involves carriage displacement to the right, in the sense of FIG. 1.

In the door-closed position shown, a vertically displaceable locking head 18 is in its down position of bolting the door 12 in its closed position, and this down position is determined after a cam-follower roll 19 (on locking head 18) has descended a cam ramp 20 to a land 21 at or near the adjacent end of a slide bar 22. Slide bar 22 is supported on a succession of guide rolls 23, which will be understood to be mounted to the frame or housing 10, and slide bar 22 has a horizontal lost-motion engagement to the carriage side plates 14, 15.

The locking head 18 and its action may be conventional. It thus may be linked as necessary to actuate a plurality of vertically spaced locking bolts, for concurrent boltings of the cell door along its closing edge. However, for present purposes, it suffices to identify a single bolting action, namely, to a downwardly open slot formation 25 in the downward flange along the bottom edge of the cell door. To this end, a vertical locking column 26 lines the closing edge of the door opening and provides a protective housing for linkage 27 suspended from and therefore effectively part of locking head 18. The locking bolt is a rocker arm 28 pinned to the lower end of linkage 27, so that when follower roll 19 is caused to ride up the ramp of cam 20, bolt 28 disengages the slot 25 of the cell door.

Figure 3:
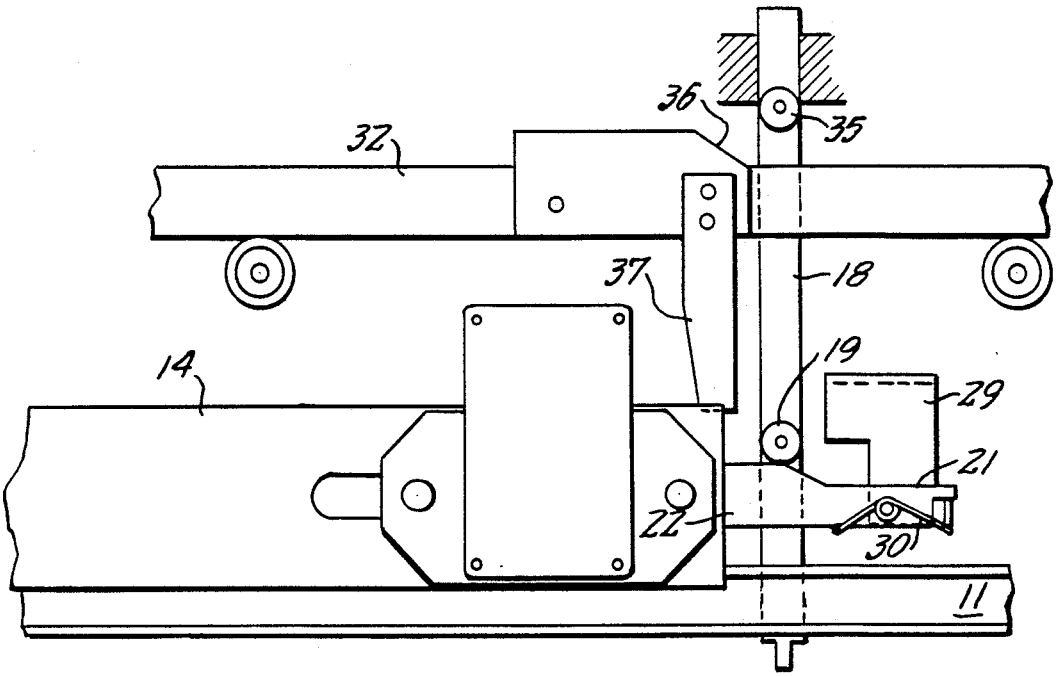
FIGS. 3 and 4 are simplified fragmentary views to illustrate two different modes of unlocking the system of FIG. 1.

For enhanced security of the bolted-door condition, a deadlock device 29 having the front-elevational profile of an inverted "L" is pivotally carried at the end of slide bar 22, being shown in FIG. 1 to be urged by a spring 30 to its normal upper limit of pivotal action, wherein the horizontal offset of the "L" is positioned above follower roll 19, thereby foreclosing any elevating displacement of the locking head. However, it will be understood that upon a lost-motion displacement of slide bar 22 to the right (as will later be more fully described), the deadlock device 29 will be carried out of deadlocking position in good time to permit cam 20 to elevate the locking head and to unbolt the cell door. This relationship is specifically illustrated by the fragmentary diagram of FIG. 3.

Figure 2B:
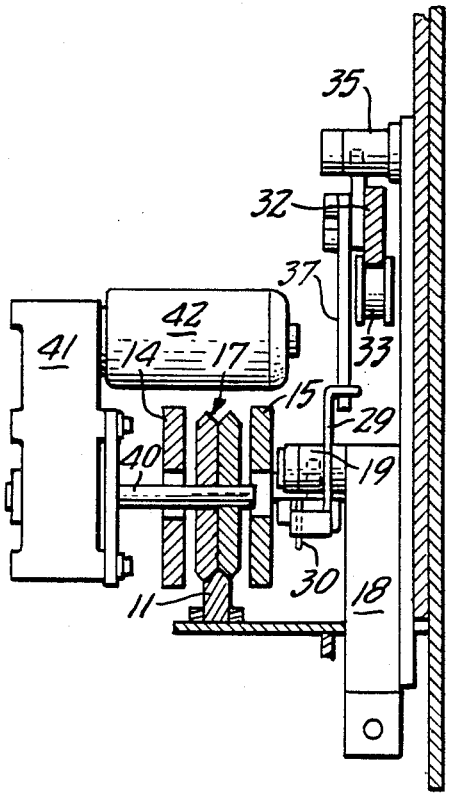
Figure 4:
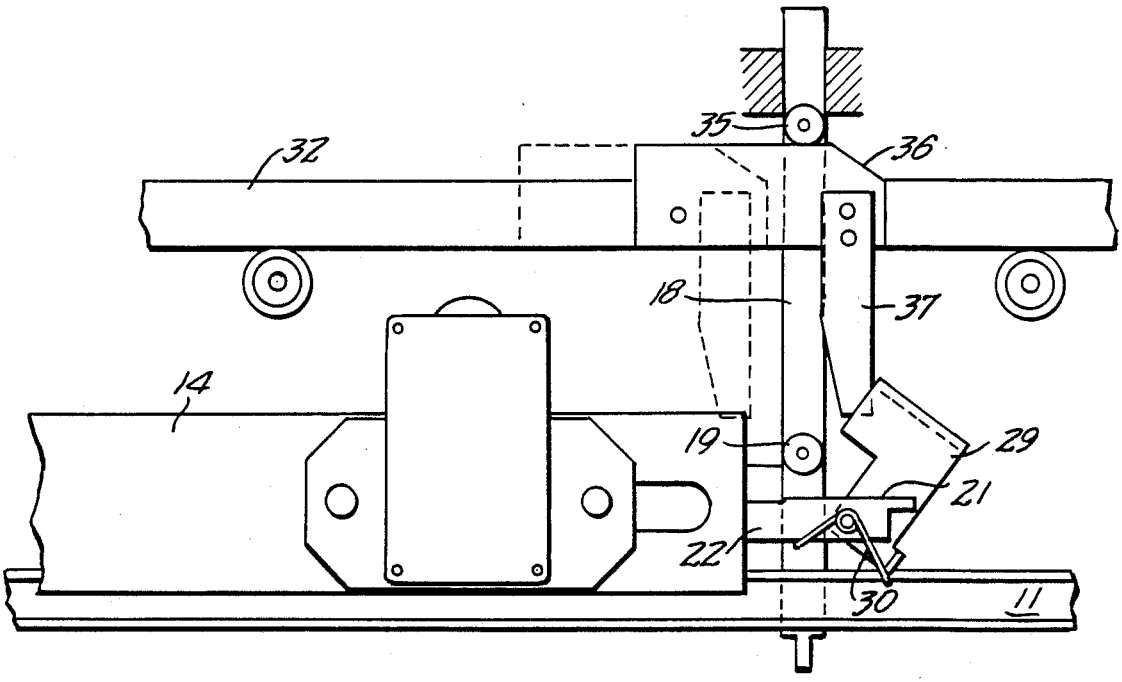

It is a requirement of jail-cell design that provision be made for emergency release of the dead-lock and bolting mechanism of all cell doors simultaneously, as in the event of a fire. To this end, an elongate emergency release bar 32 will be understood to extend horizontally through the housing 10 for each of a succession of adjacent cells, being shown supported on a series of spaced guide rolls 33. As shown in FIGS. 2A and 2B, a suitably guided vertical plate 18' forms an upper extension part of the locking head 18 and mounts a cam-follower roll 35 which (in the down or locking position of the locking head) is poised to be engaged by the ramp 36 of a cam that is carried by release bar 32; also carried by release bar 32 is a downward arm 37 poised to engage and pivotally deflect the deadlock device 29, against the resilient force of spring 30, in the event of an emergency actuation of release bar 32, in the direction left-to-right, in the sense of FIG. 1. All bolt and deadlock mechanisms are thus releasable, resulting in the mechanism in each cell having the relationship shown by the diagram of FIG. 4.

Returning now to the carriage and its relation to rail 11, the left-end roller 16 is an idler (i.e., not driven); it is rotatable, as in antifriction bearings (not shown), on a fixed shaft which connects and spaces the carriage side plates. In contrast, the right-end roller 17 is driven by a shaft 40 that is journaled in a drive unit 41 which is connected to and therefore effectively part of the slide bar 22. The drive unit 41 includes a reversible electric motor 42 and a train of gears 43, 44, 45 to the shaft 40 for roller 17; the housing for drive unit 41 is bolted to a plate 46 which defines right and left ear formations to establish a horizontal span S between fixed connections of drive unit 41 to slide bar 22. These connections pass through matching elongate slot formations in the carriage side plates 14, 15 in order to provide the lost-motion relationship which has already been mentioned.

More specifically, the slot formations in the carriage side plates (14, 15) comprise a relatively wide central slot 46' and matching narrower end slots 47, 48 which communicate with the central slot 46. The end slots 47, 48 have parallel upper and lower edges which are spaced slightly in excess of the diameter of cylindrical rolls 49, 50 which have antifriction-bearing support on tie-rod connections 51, 52 between plate 46 and slide bar 22.

The description of parts is completed by identifying a down ramp cam formation 53 at the left end of slide bar 22, to enable an automatic locking of cell door 12 in its full-open position, as will become clear from considering a full cycle of door-opening and closing action. Also identified is an abutment or projection 54 carried by or forming part of the carriage side plate 15 and poised to foreclose carriage movement (i.e., door opening) unless and until locking head 18 is raised, as by cam-20 action on roll 19.

Starting with the closed condition depicted in FIGS. 1 and 2A, excitation of motor 42 in the direction to drive roller 17 clockwise is initially operative solely to advance the drive unit 41 and slide bar 22 through the lost-motion distance D, in the course of which the cylindrical rolls 49, 50 are free to ride on one or the other of the parallel edges of their respective slots 47, 48. This initial displacement unlocks the door and places the parts in the relation shown in FIG. 3, at which point the cylindrical roll 49 has abutted the right-hand limit of lost motion, namely the end of slot 47, so that continued motor drive in the same direction is operative to displace door 12 to its open position. In the course of this displacement, follower roll 19 rides the cam-elevated profile of slide bar 22, and it will be understood that, in immediate approach to the full-open position of the door, follower roll 19 descends the ramp of cam 53, thus allowing bolt 28 to reset in another slot (not shown) in the bottom edge of the door.

The door remains locked in open condition, with drive unit 41 at the right-hand limit of lost motion, until motor 42 is excited for drive in the opposite direction. Again, the initial displacement is solely that of drive unit 41, leftward through distance D, thus displacing slide bar 22 to the left and using cam 53 to unbolt the door. Continued motor excitation causes cylindrical roll 50 to abut the left end of slot 48, whereafter drive roller 17 drives the carriage and door 12 in the closing direction. At completion of door closure, follower roll 19 descends the ramp of cam 20 and enters beneath the deadlock arm of device 29, restoring all relationships to those described for FIGS. 1 and 2A.

The described invention will be seen to meet all stated objects. The drive unit 41 is at all times in traction contact with rail 11, and the power requirement for starting any displacement is at an absolute minimum, in that slide bar 22 presents little or no resistance to displacement in the course of unbolting the cell door, whether locked in closed or in open condition. Selective remote control of a particular cell door requires only simple switching control circuitry which is well within the capability of the art and which is not shown, because it forms no part of the present invention. And it will be understood that, by designing drive roller 17 for an upper limit of tractive effort with respect to rail 11, the described drive system requires no slip clutches or other technique for avoiding bodily harm, in that a body part which blocks door closure will give rise only to a harmless slip in roller-17 engagement to rail 11.

What is claimed is:

1. In a system for operating from a remote-control station one or more of a plurality of cell doors arranged substantially in horizontal alignment along a corridor or the like, wherein (a) a housing is located above each door and each door is roller suspended via its own carriage and rides a rail which extends horizontally in each housing, (b) a reversible electric motor drive is within each housing for selectively moving the associated door between open and closed positions, (c) a movable emergency release bar extends from the remote control station and through each housing, (d) a vertical locking head is adjacent each door and is connected to a bolt engageable with the associated door to hold the door in closed position, (e) a pivotal deadlock prevents vertical movement of said locking head while said bolt is holding the door in closed position, and (f) means carried by said release bar at each door is provided for operating said locking head for each door thereby unlocking all of said cell doors simultaneously; the improvement in which, at each cell-door location: (g) said deadlock means is pivotally mounted to a slide bar carried by said carriage and having limited horizontally guided lost-motion engagement to said carriage, said deadlock means at one limit of said lost-motion engagement having deadlock action to foreclose locking-head displacement from door-bolting position, and said deadlock means at the other limit of said lost-motion engagement having no deadlock relation with said locking head; (h) cam means on said slide bar coacts with said locking head for displacing the same out of door-bolting position, such coaction being in the course of slide-bar movement from said one to said other limit of said lost-motion engagement; and (i) said motor means is mounted to said slide bar and has an output shaft connected to drive at least one roller of said suspension; whereby, starting with a deadlocked bolted and closed condition of said door, and upon motor excitation in one direction, said one roller is driven to displace said slide bar from said one to said other limit of the lost-motion engagement, thereby unbolting said door so that, after reaching said other limit of the lost-motion engagement, continued motor drive in said one direction is operative to drive said carriage in any opening displacement of the door; and further whereby, starting with an open condition of said door, and upon motor excitation in the opposite direction, said roller may be first driven to displace said slide bar from said other to said one limit of the lost-motion engagement and continued motor drive in said opposite direction is operative to drive said carriage in a closing displacement of the door, with said cam means returning the locking head to door-bolting and dead-locked condition upon completion of the door-closing displacement.

2. The improved system of claim 1, in which said deadlock means is spring urged to a normal pivoted position of deadlocking relation to said locking head, and in which actuation of said emergency release bar is operative to pivot said deadlock means against spring action and out of deadlocking relation with said locking head.

3. The improved system of claim 1, in which said roller is one of two longitudinally spaced rollers for each carriage, the second of said rollers being pivotally connected to said carriage and therefore not subject to the lost-motion displaceability of said one roller.

4. The improved system of claim 1, in which the horizontal guidance of the lost-motion engagement is via one or more longitudinally spaced rolls riding one or more horizontal ways.

5. The improved system of claim 4, in which the number of spaced rolls is two.

6. The improved system of claim 5, in which said two spaced rolls are connected to said slide bar at equal but longitudinally opposed distances from motordrive connection to said one roller.

7. The improved system of claim 1, in which said slide bar extends substantially the length of said carriage, said cam means being a first of two cams, of opposing slope at or near the respective ends of said slide bar, whereby upon approach to and attaining the door-open limit of carriage displacement, said locking head may be operative to bolt the door in its open position.

8. The improved system of claim 1, in which the engaged area of said one roller riding said rail is so selected in terms of the gravitational load upon the engaged area and in terms of motor torque deliverable to said roller, that a safety threshold of tractive force characterizes the roller-to-rail engagement, said safety threshold being selected to preclude bodily harm to an individual caught in the path of door-closing displacement.

* * * * *